US008162143B2

(12) United States Patent
Hausmann

(10) Patent No.: US 8,162,143 B2
(45) Date of Patent: Apr. 24, 2012

(54) UNITED NATIONS CERTIFIED 4G FIBERBOARD BOX

(75) Inventor: Donald H. Hausmann, Houston, TX (US)

(73) Assignee: Hazmatpac, Inc., Houston, TX (US)

( * ) Notice: Subject to any disclaimer, the term of this patent is extended or adjusted under 35 U.S.C. 154(b) by 0 days.

(21) Appl. No.: 13/042,140

(22) Filed: Mar. 7, 2011

(65) Prior Publication Data

US 2011/0155601 A1 Jun. 30, 2011

Related U.S. Application Data

(62) Division of application No. 12/250,291, filed on Oct. 13, 2008, now Pat. No. 7,954,637.

(51) Int. Cl.
*B65D 85/84* (2006.01)

(52) U.S. Cl. ..... 206/524.4; 229/120.06; 229/120.36

(58) Field of Classification Search .... 206/524.1–524.6, 206/386, 561, 523, 600; 229/120.02, 120.06, 229/120.23–120.25, 120.36
See application file for complete search history.

(56) References Cited

U.S. PATENT DOCUMENTS

| | | | | |
|---|---|---|---|---|
| 3,880,343 | A * | 4/1975 | Rockefeller | 229/120.26 |
| 5,992,634 | A * | 11/1999 | Woodring et al. | 206/524.3 |
| 7,494,014 | B2 | 2/2009 | Martinez | |
| 2006/0243784 | A1 * | 11/2006 | Glaser et al. | 229/117.16 |
| 2007/0095883 | A1 * | 5/2007 | Boehm | 229/120.36 |
| 2009/0072016 | A1 * | 3/2009 | Molle | 229/120.36 |

OTHER PUBLICATIONS

Office Action for U.S. Appl. No. 12/250,291, Oct. 26, 2010 (9 p.).

* cited by examiner

*Primary Examiner* — Luan K Bui
(74) *Attorney, Agent, or Firm* — Conley Rose, P.C.

(57) ABSTRACT

A 4G fiberboard box certified for shipping hazardous materials in accordance with United Nations regulations. In some embodiments, the 4G fiberboard box includes an outer shell, a three-piece partition assembly, a top insert and a bottom insert. The outer shell has a width and a length, each no greater than ⅓ of 46 inches. Thus, the 4G fiberboard box is shippable in a 3×3 configuration on a standard 46"×46" pallet. The three-piece partition assembly is disposed within the shell and has four compartments, each compartment configured to receive a container storing hazardous material. The top insert and bottom insert are also disposed with the shell, with the partition assembly positioned therebetween.

6 Claims, 13 Drawing Sheets

UNITED NATIONS CERTIFIED 4G FIBERBOARD BOX

CROSS-REFERENCE TO RELATED APPLICATIONS

This application is a divisional application of U.S. Ser. No. 12/250,291 filed on Oct. 13, 2008 U.S. Pat. No. 7,954,637.

STATEMENT REGARDING FEDERALLY SPONSORED RESEARCH OR DEVELOPMENT

Not applicable.

BACKGROUND OF THE INVENTION

1. Field of the Invention

The present invention relates generally to a fiberboard box. More particularly, the present invention relates to a 4G fiberboard box that meets United Nations regulations governing certified containers for the transportation of hazardous materials.

2. Description of Related Art

Goods that are classified as dangerous for transport range from those which are highly dangerous, such as explosives and fuming acids, to everyday products, such as paints, solvents and pesticides found in the home and at work. Dangerous goods, typically referred to as hazardous materials in the United States, may be substances or products. Due to their hazardous nature, the transport of such goods is regulated to ensure the safety of life, of the ship, aircraft or vehicle transporting the goods, and of other goods being transported. The basis of all national and international regulations for the safe transport of dangerous goods is the recommendations of the United Nations Committee of Experts, published in "The Orange Book." The United States has adopted these recommendations in the form of the Hazardous Materials Regulations (Title 49 CFR Parts 100-185), which is published by the United States Department of Transportation and governs the transport of hazardous materials in the United States.

When transporting hazardous materials in the United States, the packaging used to contain the hazardous material in most cases must be certified to United Nations standards as defined in the Hazardous Materials Regulations. These standards require the packaging to be of a design-type certified by a national competent authority. Packaging which meets the appropriate United Nations specifications is often referred to as "type-approved", "UN Approved" or "UN certified" and marked in a particular way, prefixed by the United Nations logo and followed by codes.

The certification process includes testing the packaging against the appropriate UN specification to ensure its suitability for the carriage of certain hazardous goods. These test procedures are intended to ensure that packaging which will contain hazardous materials can withstand normal conditions of transportation and are considered to represent the minimum acceptable design standards/requirements. The design requirements consist of a number of performance oriented tests related to packaging integrity. The severity of the tests varies according to the Packing Group. The UN Committee has assigned all dangerous goods to one of three Packing Groups: Packing Group I—High danger; Packing Group II—Medium danger; and Packing Group III—Low danger. The purpose of the tests is to prove a design to the Packing Group level of performance. The objective is a design that, when filled and closed for shipment, will consistently perform at that level. Packaging is tested in the "as for shipment" condition, and there are five main tests to which it is subjected. These are the drop test, the stacking test, the leakproof test, the hydrostatic test, and the optional vibration test. Each of these five tests has specific guidelines set up to ensure that the packaging being tested will conform to the respective packing group requirement. This testing is a comprehensive process, carried out by independent laboratories that are legally authorized to issue a formal UN certification of the "worthiness" of the packaging for use with hazardous materials.

In the case of non-bulk packagings and packages, there are additional design requirements which must also be met. These additional requirements are directed to certain criteria regarding the physical design of the packaging, rather than its performance during testing. In particular, Section 173.24a of Hazardous Materials Regulations (Title 49 CFR Parts 100-185) requires that "inner packagings of combination packagings must be so packed, secured and cushioned to prevent their breakage or leakage and to control their shifting within the outer packaging under conditions normally incident to transportation. Cushioning material must not be capable of reacting dangerously with the contents of the inner packagings or having its protective properties significantly weakened in the event of leakage."

To satisfy the testing requirements, conventional non-bulk packaging and packages require certain physical dimensions. In other words, these packages must be large enough to withstand the conditions prescribed by the testing requirements. As the size of these packages increases, storage requirements for these containers also increase. Thus, fewer packages may occupy a particular storage location, and less volume of hazardous material may be transported. For example, one commonly used shipping pallet is 46"×46" in size. Some conventional non-bulk packages do not fit efficiently within the perimeter of this commonly used pallet, yielding at least some un-utilized pallet space.

Further, some conventional non-bulk packages satisfy the testing requirements at the expense of not meeting the requirements of Section 173.24a. For instance, some non-bulk packages utilize molded-pulp inserts as cushioning materials. When exposed to liquid, such as that stored within the non-bulk package, molded-pulp weakens and loses its cushioning ability. Other non-bulk packages utilize expanded polystyrene as cushioning material. Polystyrene dissolves and may form a flammable material on contact with hydrocarbons, which are often shipped as hazardous materials.

SUMMARY OF THE PREFERRED EMBODIMENTS

A United Nations certified 4G fiberboard box or shipping container is disclosed. In some embodiments, the shipping container includes an outer shell and an inner partition assembly. The outer shell has a width and a length, wherein the width and the length are each no greater than ⅓ of 46 inches. Also, the shipping container is formed solely of corrugated fiberboard, configured to meet United Nations regulations governing transport of hazardous materials, and configured to receive and contain up to four four-liter pharmaceutical glass bottles.

In some embodiments, the shipping container includes an outer shell and an inner partition assembly. The outer shell is configured such that a three by three array of nine of the shipping containers is transportable on a standard 46 inch by 46 inch pallet. Also, the shipping container is formed solely of corrugated fiberboard, configured to meet United Nations regulations governing transport of hazardous materials, and configured to receive and contain up to four four-liter pharmaceutical glass bottles.

In some embodiments, the 4G fiberboard box includes an outer shell configured such that a three by three array of nine of the shipping containers is transportable on a standard 46 inch by 46 inch pallet, and a partition assembly disposed within the shell. The partition assembly has four compartments with each compartment configured to receive a four-liter container, and each container configured to store hazardous material. Also, the 4G fiberboard box is certified for shipping hazardous materials in accordance with United Nations regulations.

In some embodiments, the 4G fiberboard box includes an outer shell, a three-piece partition assembly, a top insert, and a bottom insert. The outer shell is configured such that a three by three array of nine of the shipping containers is transportable on a standard 46 inch by 46 inch pallet. The three-piece partition assembly is disposed within the shell and has four compartments with each compartment configured to receive a container storing hazardous material. The top insert and bottom insert are also disposed within the shell, with the partition assembly positioned therebetween.

Thus, the 4G fiberboard box comprises a combination of features and advantages that enable it to satisfy United Nations regulations governing the transport of hazardous materials and to be transportable on a standard 46"×46" pallet in a 3×3 configuration. These and various other characteristics and advantages of the preferred embodiments will be readily apparent to those skilled in the art upon reading the following detailed description and by referring to the accompanying drawings.

BRIEF DESCRIPTION OF THE DRAWINGS

For a more detailed understanding of the preferred embodiments, reference is made to the accompanying Figures, wherein.

NOTATION AND NOMENCLATURE

Figure 1B:
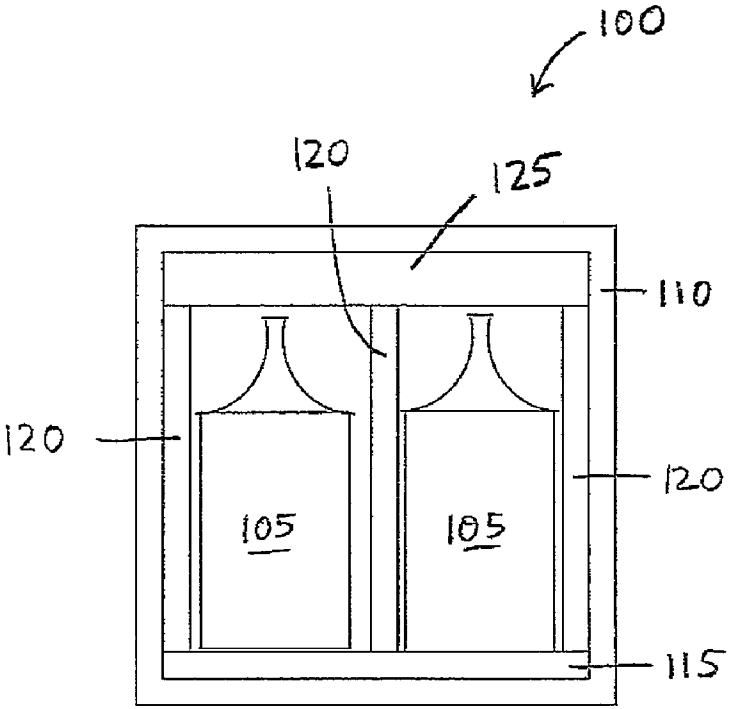
FIGS. 1A and 1B show perspective and cross-sectional side views, respectively, of a 4G fiberboard box in accordance with the principles disclosed herein.

Certain terms are used throughout the following description and claims to refer to particular system components. This document does not intend to distinguish between components that differ in name but not function. Moreover, the drawing figures are not necessarily to scale. Certain features of the invention may be shown exaggerated in scale or in somewhat schematic form, and some details of conventional elements may not be shown in the interest of clarity and conciseness.

In the following discussion and in the claims, the term "comprises" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections.

DETAILED DESCRIPTION OF THE PREFERRED EMBODIMENTS

Figure 1A:
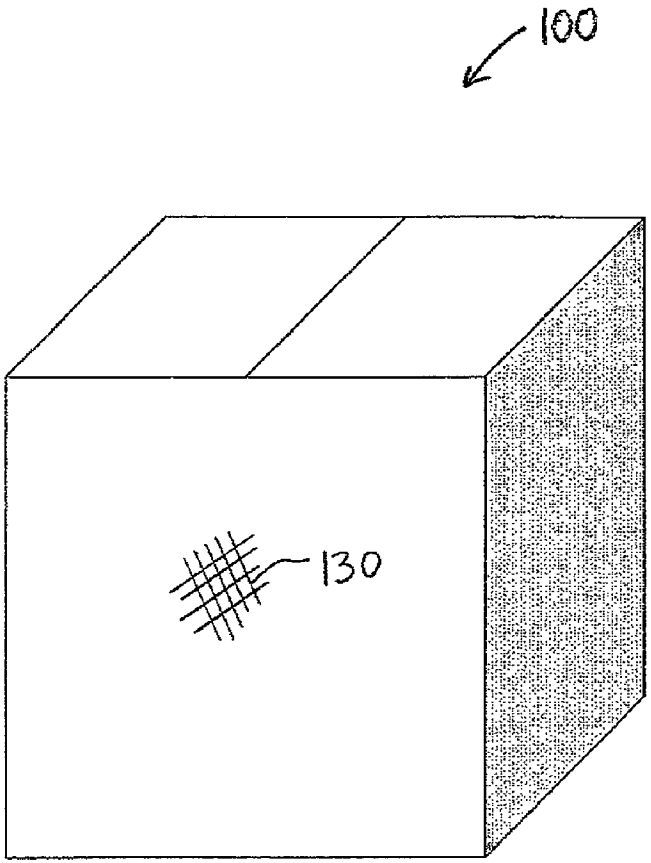
Figure 2B:
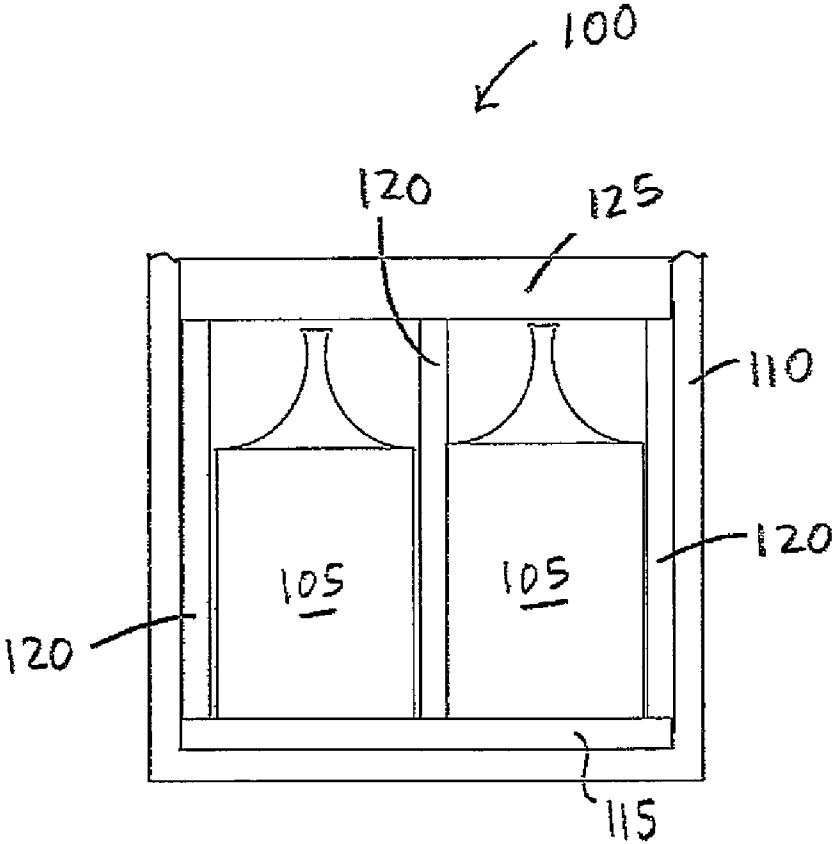
FIGS. 2A and 2B are cross-sectional top and side views, respectively, of the 4G fiberboard box of FIGS. 1A and 1B, illustrating the top insert installed within the shell of the 4G fiberboard box.
Figure 2A:
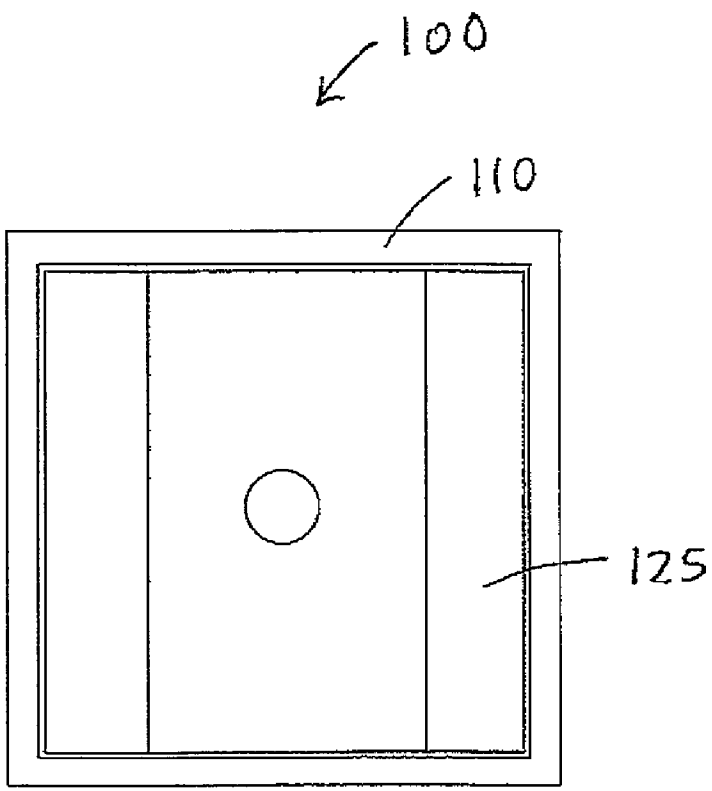
Figure 3B:
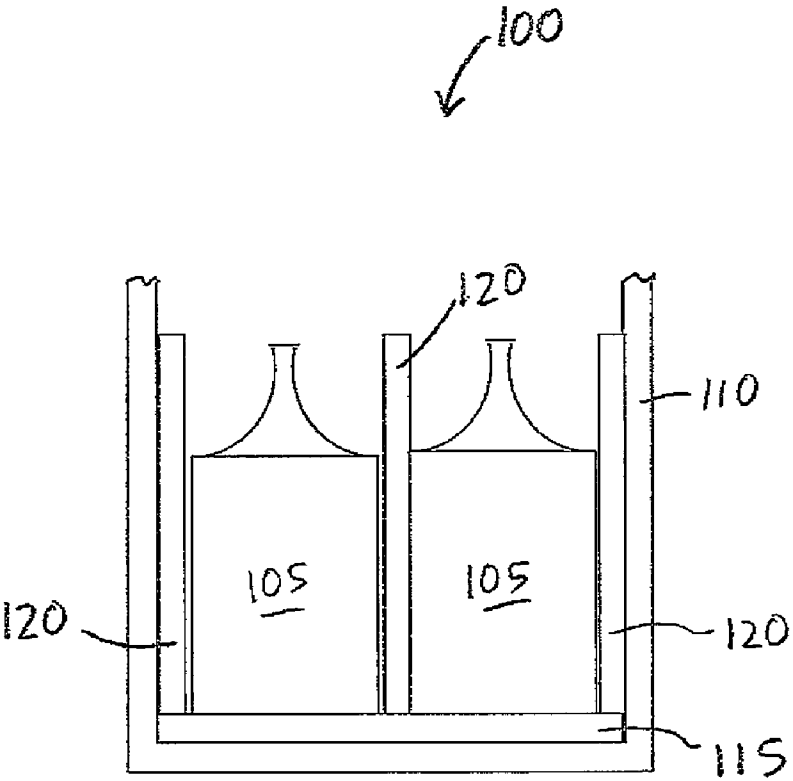
FIGS. 3A and 3B are cross-sectional top and side views, respectively, of the 4G fiberboard box of FIGS. 1A and 1B, illustrating the partition assembly installed within the shell of the 4G fiberboard box.
Figure 3A:
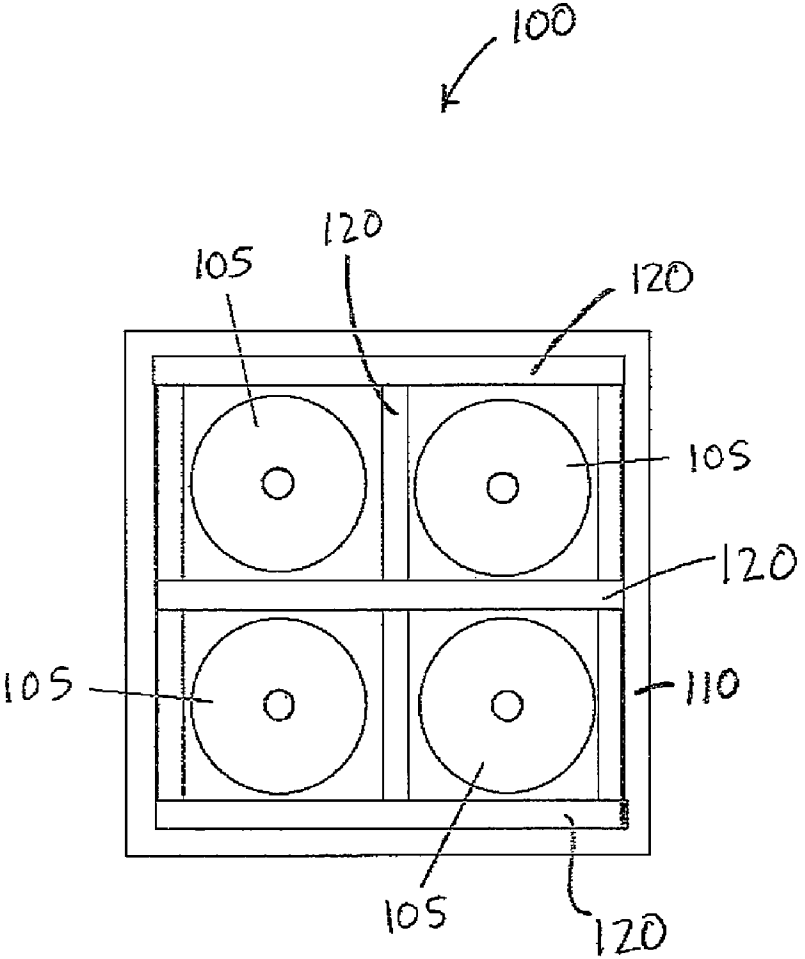

Referring to FIGS. 1A and 1B, there are shown perspective and cross-sectional side views, respectively, of an embodiment of a 4G fiberboard box (hereinafter "box") 100 for storing up to four containers 105 configured to contain hazardous material. In some embodiments, containers 105 are four-liter pharmaceutical glass bottles. Box 100 includes an outer shell 110, a bottom insert 115 upon which containers 105 are positioned, a partition assembly 120 disposed between containers 105 to prevent each container 105 from shifting and contacting another when box 100 is moved, and a top insert 125. Turning to FIG. 2A, box 100 is depicted in cross-section without its top, thereby exposing to view top insert 125 installed within shell 110. Referring now to FIG. 2B, containers 105, partition assembly 120 and bottom insert 115 are positioned below top insert 125 within shell 110. When top insert 125 is removed from shell 110, containers 105 and partition assembly 120 are exposed to view, as illustrated by FIGS. 3A and 3B.

Figure 4:
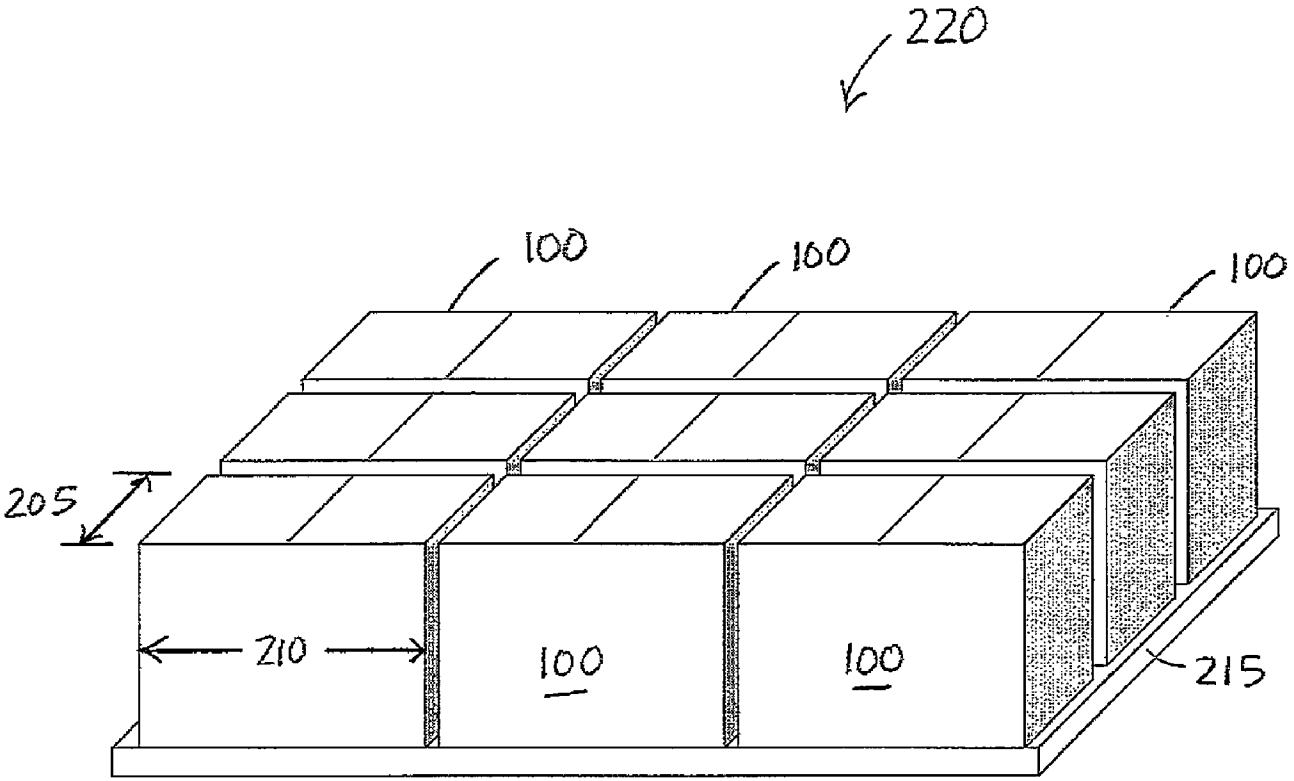
FIG. 4 illustrates a 3×3 configuration of the 4G fiberboard box of FIGS. 1A and 1B on a 46"×46" pallet.

Shell 110, bottom insert 115, partition assembly 120 and top insert 125 are each made entirely from individual sheets of corrugated fiberboard 130 which are folded and/or assembled to form their respective structures, as will be described. The external dimensions of box 100 are such that nine boxes 100 may be arranged in a 3×3 configuration 220 that fits within the perimeter of a 46"×46" pallet 215, as illustrated by FIG. 4. In other words, the length 205 and the width 210 of box 100 are each no greater than ⅓ of 46", or 15⅓". The internal dimensions of box 100, in particular, partition assembly 120, are configured to store up to four four-liter pharmaceutical glass bottles, or other containers 105 having equivalent spatial requirements.

Figure 5B:
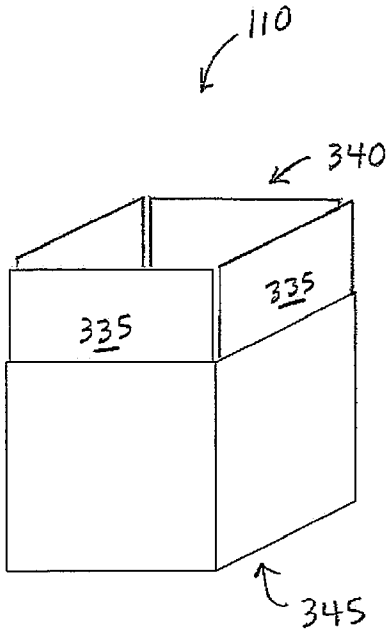
FIGS. 5A and 5B are unassembled and assembled views, respectively, of the shell.
Figure 5A:
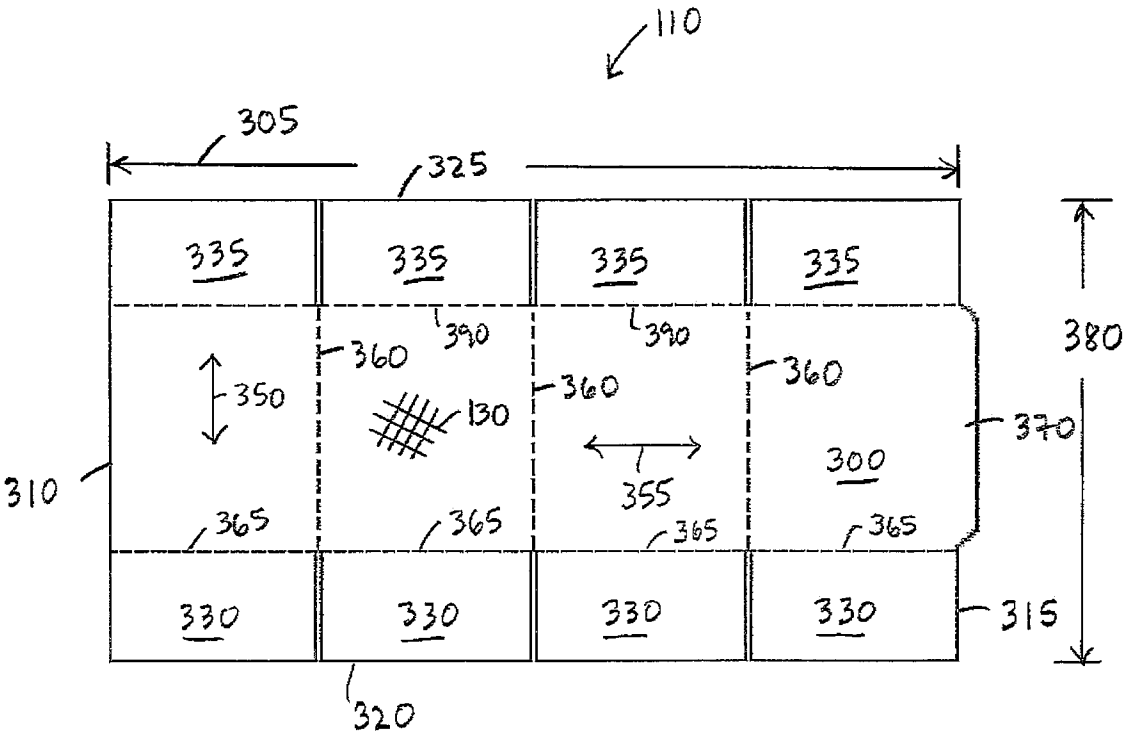

Turning next to FIG. 5A, shell 110 is shown in an unassembled configuration. Shell 110 is formed from a single sheet 300 of corrugated fiberboard 130 having a generally rectangular shape with a length 305 extending between two edges 310, 315 and a width 380 extending between two edges 320, 325. A tab 370 extends substantially normally from edge 315 and enables fastening of edge 315 to edge 310. In some embodiments, tab 370 is glued to a surface of sheet 300 proximate edge 310 when sheet 300 is folded or assembled as shown in FIG. 5B. The surface of shell 110 to which tab 370 is fastened may be either the surface that forms the interior or the exterior surface of shell 110 when shell 110 is assembled. Still referring to FIG. 5A, edge 320 includes four flaps 330, and edge 325 includes four flaps 335. All flaps 330, 335 are substantially the same size. When shell 110 is assembled, flaps 335 form the top 340 (FIG. 5B) of shell 110 and box 100, while flaps 330 form the bottom 345 (FIG. 5B) of shell 110 and box 100. To promote the strength of shell 110, and thus box 100, the corrugation of fiberboard 130 preferably extends normally between edges 320, 325 of sheet 300, indicated by direction 350, or normally between edges 310, 315 of sheet 300, indicated by direction 355. In other embodiments, however, the corrugation direction of sheet 300 may extend in a direction angularly offset from directions 350, 355.

To assemble shell 110, as shown in FIG. 5B, sheet 300 is folded first along dotted lines 360 and tab 370 is fastened to edge 310 of sheet 300 such that when fastened, sheet 300 forms a hollow, substantially rectangular enclosure open at both ends. To complete assembly of shell 110, flaps 330 are folded along dotted lines 365 to form base 345 of box 100 and sealed, for example, using tape to prevent flaps 330 from opening under load from contents later placed in box 100 and/or movement of box 100 during shipping and handling. Flaps 335 remain in their substantially vertical orientation, or open, to expose the interior of shell 110, thereby enabling shell 110 to subsequently receive bottom insert 115, partition assembly 120, up to four containers 105 and top insert 125.

Figure 6B:
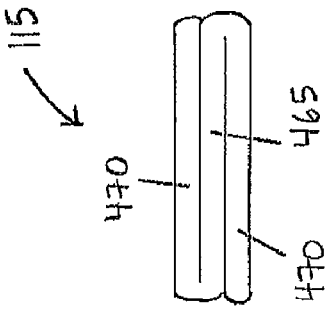
FIGS. 6A and 6B are unfolded and folded views, respectively, of the bottom insert.
Figure 6A:
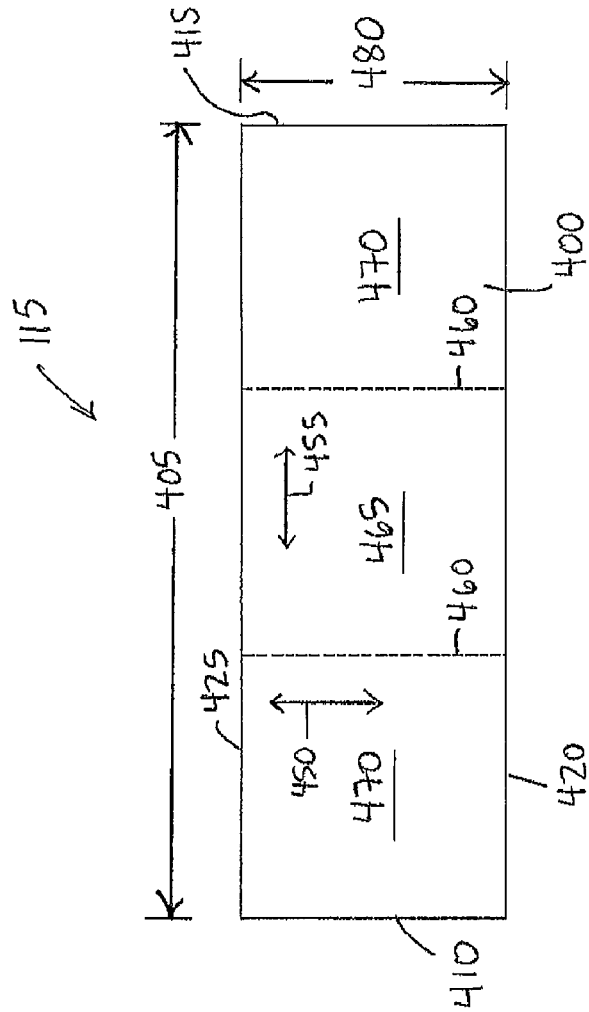

Referring now to FIG. 6A, bottom insert 115 is shown in an unfolded configuration. Bottom insert 115 is formed of a single sheet 400 of corrugated fiberboard 130 having a generally rectangular shape with a length 405 extending between two edges 410, 415 and a width 480 extending between two edges 420, 425. Width 480 and length 405 are such that when bottom insert 115 is folded as shown in FIG. 6B, bottom insert 115 fits within shell 110, as illustrated by FIG. 1B. More specifically, width 480 is less than the interior width and the interior length of shell 110, while length 405 is no more than three times the interior width or length of shell 110. To promote the strength of bottom insert 115, and thus box 100, the corrugation of fiberboard 130 preferably extends normally between edges 420, 425 of sheet 400, indicated by direction 450, or normally between edges 410, 415 of sheet 400, indicated by direction 455. In other embodiments, however, the corrugation direction of sheet 400 may extend in a direction angularly offset from directions 450, 455.

To install bottom insert 115 within shell 110, sheet 400 is first folded along dotted lines 460 such that center portion 465 of sheet 400 is sandwiched between end portions 470 of sheet 400, as shown in FIG. 4B. Bottom insert 115 is then positioned within assembled shell 110 (FIG. 5B) such that either end portion 470 abuts and is supported by base 345 of box 100. Once so positioned, bottom insert 115 promotes the structural integrity of box 100 proximate its base 345, as well as provides some cushioning for containers 105 (FIG. 1B) when stored within box 100. One skilled in the art will readily appreciate that while bottom insert 115, as described and illustrated, is formed from a single sheet folded into three layers, in other embodiments, the bottom insert may be formed from multiple smaller sheets folded and/or stacked to form an equivalent structure.

Figure 7B:
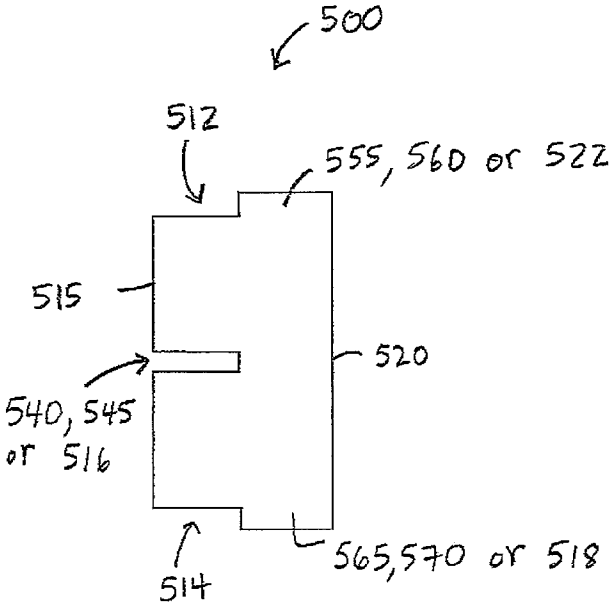
FIGS. 7A and 7B are unfolded and folded views, respectively, of one panel of the partition assembly.
Figure 7A:
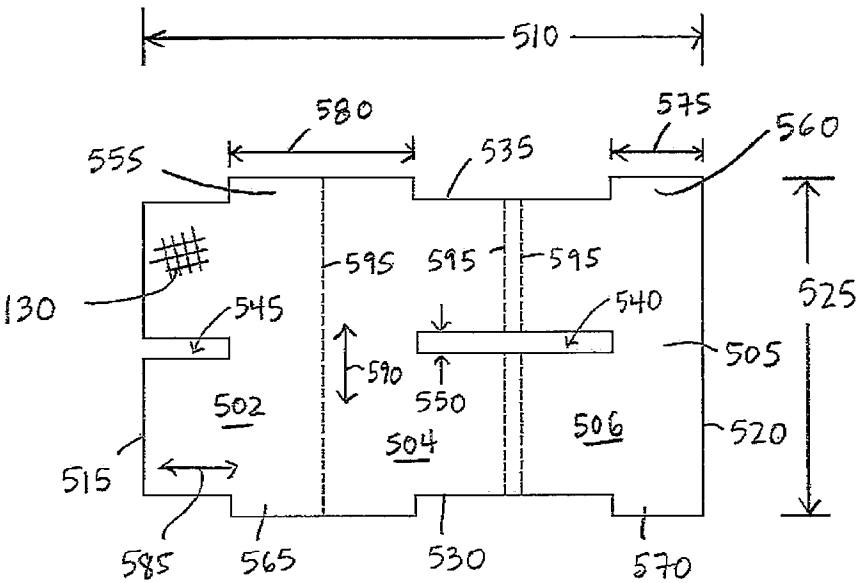

Referring to FIGS. 7A and 7B, a single panel 500 of partition assembly 120 is shown in unfolded and folded configurations, respectively. Panel 500 is formed from a single sheet 505 of corrugated fiberboard 130 having a generally rectangular shape with a length 510 extending between two edges 515, 520, and a width 525. Sheet 505 includes a slot 540 offset to the right of the midsection of sheet 505 and a slot 545 proximate edge 515. Slots 540, 545 extend substantially in a direction normal to edges 515, 520 and have substantially the same width 550. Sheet 505 further includes two tabs 555, 560 extending from an edge 535 and two tabs 565, 570 extending from an edge 530. Tabs 560, 570 each have a length 575 that is substantially equal to half the length 580 of tabs 555, 565. To promote the strength of panel 500, the corrugation of fiberboard 130 preferably extends normally between edges 530, 535 of sheet 505, indicated by direction 590. In other embodiments, however, the corrugation direction of sheet 505 may extend normally between edges 515, 520 of sheet 505, indicated by direction 585, or in a direction angularly offset from directions 585, 590.

In this exemplary embodiment, partition assembly 120 is formed from six panels 500, each folded to assume the configuration illustrated by FIG. 7B and then assembled as will be described with reference to FIG. 8. To form partition assembly 120, each panel 500 is preferably folded along dotted lines 595 such that left portion 502 is sandwiched between center portion 504 and right portion 506, yielding the folded configuration shown in FIG. 7B. Alternatively, each panel 500 may be folded along dotted lines 595 such that right portion 506 is sandwiched between center portion 504 and left portion 502, yielding the folded configuration shown in FIG. 7B. When folded along dotted lines 595 as described, slot 540 is folded approximately at its midpoint, such that one half of slot 540 overlaps the other half of slot 540, and both halves of slot 540 align with slot 545. Also, tab 555 is folded approximately at its midpoint, such that one half of tab 555 overlaps the other half of tab 555, and both halves of tab 555 align with tab 560. Similarly, tab 565 is folded approximately at its midpoint, such that one half of tab 565 overlaps the other half of tab 565, and both halves of tab 565 align with tab 570. When tabs 555, 560 align as shown in FIG. 7B, notch 512 is formed in panel 500 adjacent aligned tabs 555, 560. Similarly, when tabs 565, 570 align also as shown in FIG. 7B, notch 514 is formed in panel 500 adjacent aligned tabs 565, 570. For convenience, aligned tabs 555, 560 are referred to herein as tab 522, and aligned tabs 565, 570 are referred to herein as tab 518. Also, aligned slots 540, 545 are referring to herein as slot 516. In some embodiments, portions 502, 504, 506 are then fastened together by the application of tape across portions 502, 504, 506 or other equivalent fastening device to maintain panel 500 in the folded configuration as shown. In other embodiments, however, portions 502, 504, 506 may not be fastened together by any means.

Figure 8:
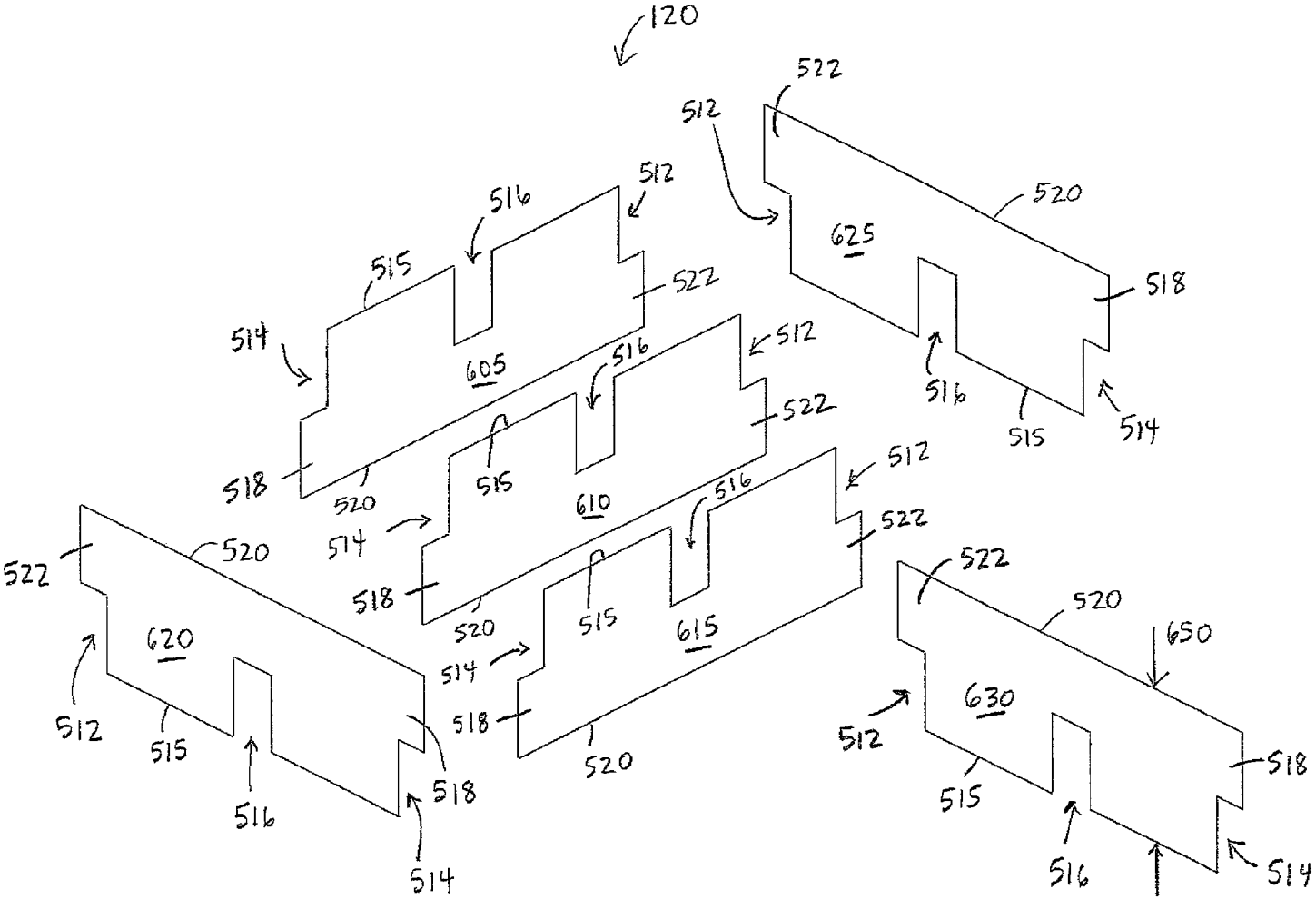
FIG. 8 is an exploded view of the partition assembly, wherein for simplicity each panel is illustrated as having only a single layer, rather than multiple layers as disclosed herein.

Turning now to FIG. 8, six folded panels 500 are shown. When assembled, these six panels 500 form partition assembly 120. Panels 605, 610, 615 are aligned with each other and oriented such that their uppermost edges are edges 515. Panels 620, 625 are also aligned with each other, while panel 630 is to the right in this figure. Panels 620, 625, 630 are oriented such that their lowermost edges are edges 515. To form partition assembly 120, panel 620 is positioned in engagement with panels 605, 610, 615 such that: notch 514 of panel 605 receives tab 522 of panel 620; notch 512 of panel 620 receives tab 518 of panel 605; slot 516 of panel 620 receives tab 518 of panel 610; notch 514 of panel 620 receives tab 518 of panel 615; and notch 514 of panel 615 receives tab 518 of panel 620. Panel 625 is positioned in engagement with panels 605, 610, 615 such that: notch 512 of panel 625 receives tab 522 of panel 605; notch 512 of panel 605 receives tab 522 of panel 625; slot 516 of panel 625 receives tab 522 of panel 610; notch 514 of panel 625 receives tab 522 of panel 615; and notch 512 of panel 615 receives tab 518 of panel 625. To complete assembly of partition assembly 120, panel 630 is positioned in engagement with panels 605, 610, 615 such that: slot 516 of panel 605 receives tab 522 of panel 630; slot 516 of panel 610 receives slot 516 of panel 630; and slot 516 receives tab 518 of panel 630.

Partition assembly 120 is next positioned within shell 110 in engagement with and supported by bottom insert 115, as shown in FIGS. 3A and 3B. Partition assembly 120 may be positioned within shell 110 such that edges 520 of panels 605, 610, 615 and edges 515 of panels 620, 625, 630 contact bottom insert 115. Alternatively, partition assembly 120 may be positioned within shell 110 in the opposite orientation, meaning with edges 515 of 605, 610, 615 and edges 520 of panels 620, 625, 630 in contact with bottom insert 115.

Referring still to FIG. 8, the height of partition assembly 120 is determined by the height 650 (see panel 630) of each panel 500. Height 650 may vary as needed or desired, its maximum value limited only by the ability of box 100 to be completed closed and sealed with bottom insert 115, partition assembly 120, containers 105 and top insert 125 disposed therein. The minimum value of height 650 is limited by the ability of box 100 to satisfy the United Nations testing requirements previously described.

Figure 9B:
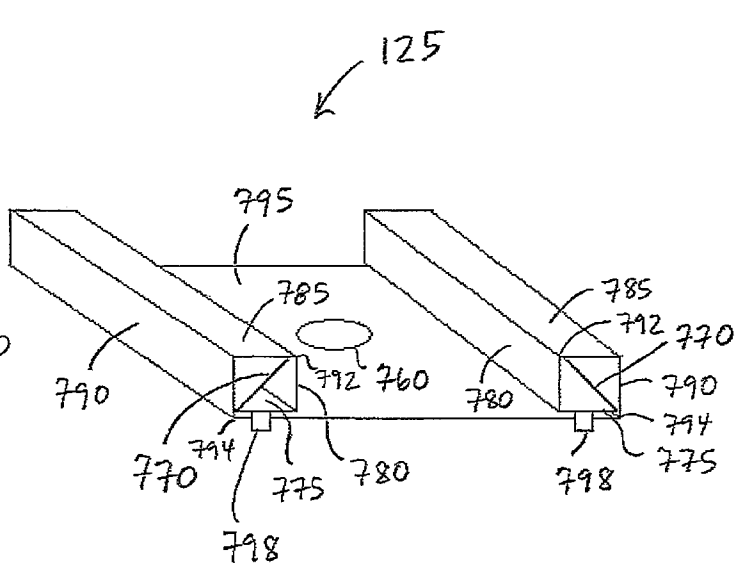
FIGS. 9A and 9B are unassembled and assembled views, respectively, of the top insert.
Figure 9A:
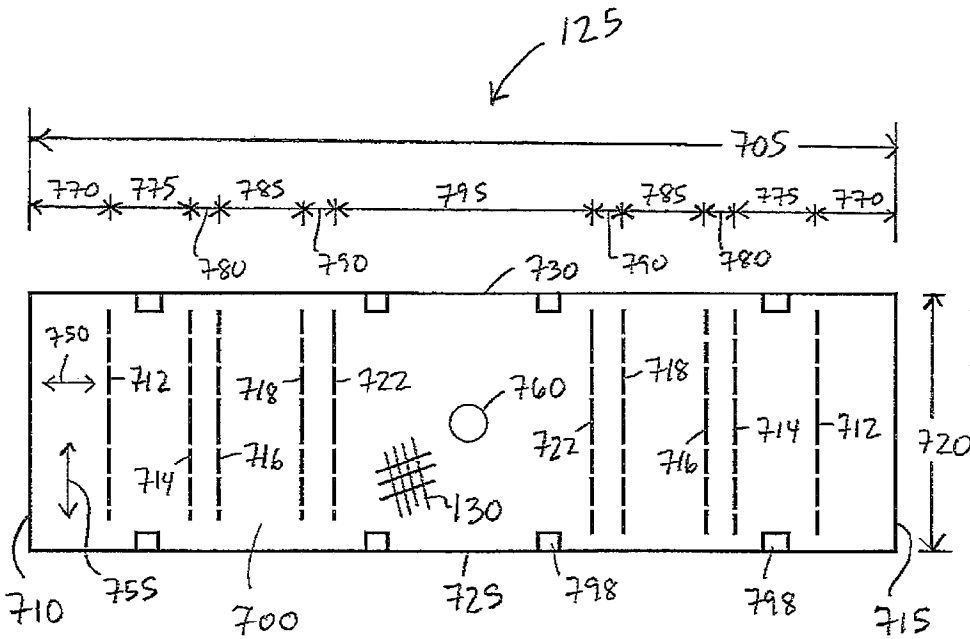

Turning next to FIG. 9A, top insert 125 is shown in an unfolded configuration. Top insert 125 is formed from a single sheet 700 of corrugated fiberboard 130 having a generally rectangular shape with a length 705 extending between two edges 710, 715 and a width 720 extending between two edges 725, 730. Width 720 and length 705 are such that when top insert 125 is folded as shown in FIG. 9B, top insert 125 will fit within shell 110, as illustrated by FIG. 2A. More specifically, width 720 is less than the interior width and the interior length of shell 110, while length 705 is no more than three times the interior width or length of shell 110. To promote the strength of top insert 125, and thus box 100, the corrugation of fiberboard 130 preferably extends normally between edges 710, 715 of sheet 700, indicated by direction 750, or normally between edges 725, 730 of sheet 700, indicated by direction 755. In other embodiments, however, the corrugation direction of sheet 700 may extend in a direction angularly offset from directions 750, 755. Sheet 700 includes a plurality of tabs 798 and a hole 760 proximate its center. Hole 760 enables insertion of top insert 125 into and removal of top insert 125 from shell 110. Once sheet 700 is folded as shown in FIG. 9B, tabs 798 are bent or folded to enable top insert 125 to retain its folded configuration.

To assemble top insert 125, it is convenient to subdivide sheet 700 along its length 705 into a plurality of sections defined by pairs of dotted lines 712, 714, 716, 718, 722. Proceeding from edge 710 and moving toward hole 760, sheet 700 is subdivided into sections 770, 775, 780, 785, 790, 795 by dotted lines 712, 714, 716, 718, 722, respectively. Similarly, proceeding from edge 715 and moving again toward hole 760, sheet 700 may be further subdivided into additional sections 770, 775, 780, 785, 790, 795 by dotted lines 712, 714, 716, 718, 722, respectively. Next, sheet 700 is folded along dotted lines 712, 714, 716, 718, 722 beginning at dotted lines 712 proximate edges 710, 715 and moving inward toward hole 760. First, each section 770 is folded along dotted line 712 toward adjacent section 775. Each section 775, with attached section 770, is then folded along dotted line 714 toward adjacent section 780. Each section 780, with attached sections 770, 775, is then folded along dotted line 716 toward adjacent section 785. Each section 785, with attached sections 770, 775, 780, is then folded along dotted line 718 toward adjacent section 790. Finally, each section 790, with attached sections 770, 775, 780, 785, is folded along dotted line 722 toward adjacent center section 795. Once sections 790 are folded in this manner, sheet 700 forms top insert 125, as shown in FIG. 9B. Sections 770 are then each adjusted to span the diagonal between edges 794, 792 formed by the folds between sections 790, 795 and sections 785, 780, respectively. By adjusting sections 770 in this manner, the structural integrity of the portions of top insert 125 formed by sections 775, 780, 785, 790 is enhanced and more resistive to forces which may be exerted on these sections 775, 780, 785, 790 during shipping and handling. Lastly, tabs 798 are folded or bent relative to their respective sections 775, 795 to enable top insert 125 to retain this folded configuration.

Once assembled as shown in FIG. 9B, top insert 125 may then be gripped using hole 760 and lowered into shell 110 over containers 105 (FIG. 1B). Returning to FIGS. 5A and 5B, flaps 335 are then folded along dotted lines 390 and sealed, for example, using tape to close top 340 of box 100, which is then ready for shipping and handling.

Figure 10:
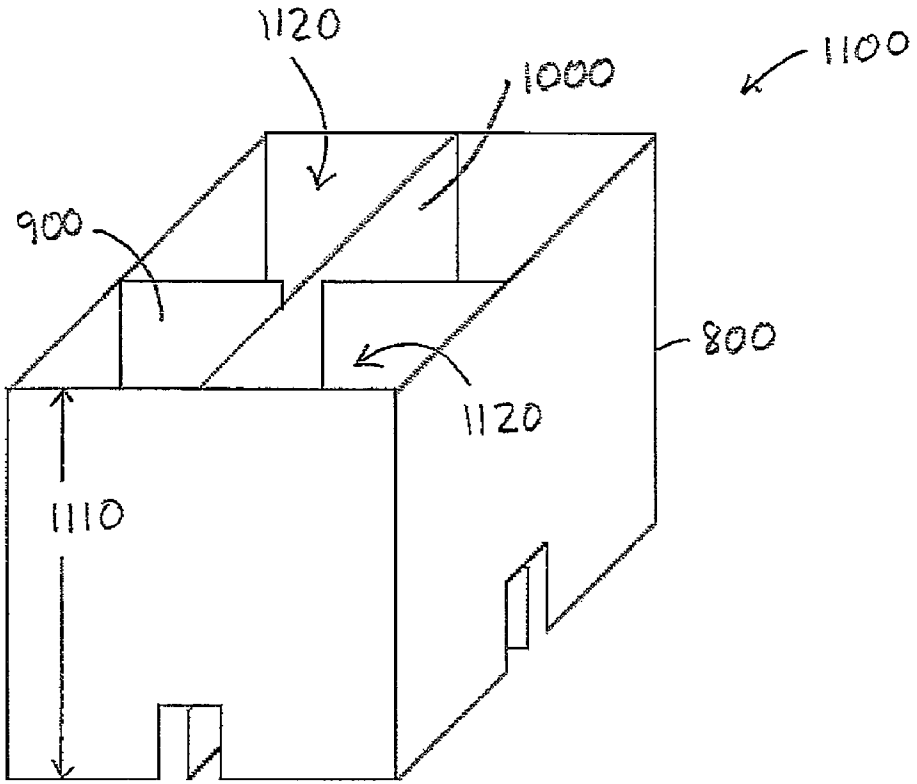
FIG. 10 is a perspective view of an alternative embodiment of the partition assembly wherein for simplicity each of the frame, first divider and second divider are illustrated as having only a single layer, rather than multiple layers as disclosed herein.

In the exemplary embodiment of a 4G fiberboard box described above with reference to and illustrated by FIGS. 1A through 9B, partition assembly 120 includes six individual pieces, specifically six substantially identical panels 500. To simplify assembly a 4G fiberboard box in accordance with the principles disclosed herein, other embodiments of the 4G fiberboard box may include a partition assembly having fewer parts. In such embodiments, the remaining components of box 100, such as shell 110, bottom insert 120 and top insert 125 may remain substantially the same as described above. For example, in some embodiments, the partition assembly may be formed from only the three distinct components. FIG. 10 illustrates one such embodiment of a partition assembly 1100 formed from a frame 800, a first divider 900 and a second divider 1000. Similar to partition assembly 120 described above, partition assembly 1100 is likewise insertable within and removal from shell 110 of box 100. Further, frame 800, first divider 900 and second divider 1000 form four open chambers 1120 with each chamber 1120 configured to receive a single container 105.

Figure 11B:
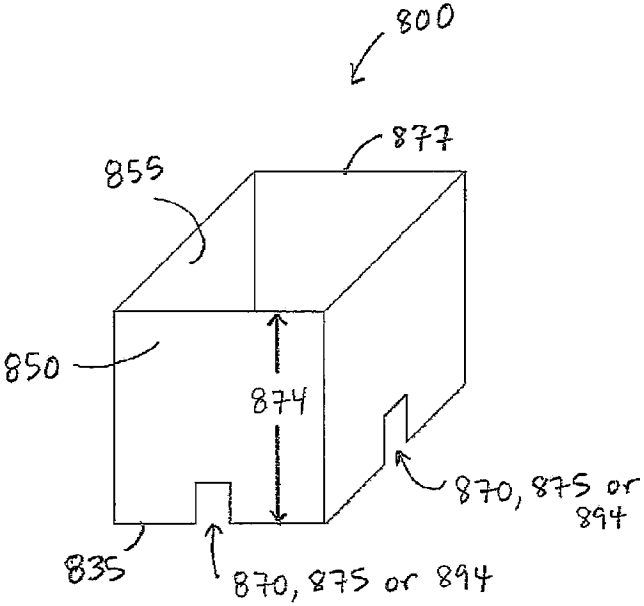
FIGS. 11A and 11B are unassembled and assembled views, respectively, of a frame of the partition assembly of FIG. 10.
Figure 11A:
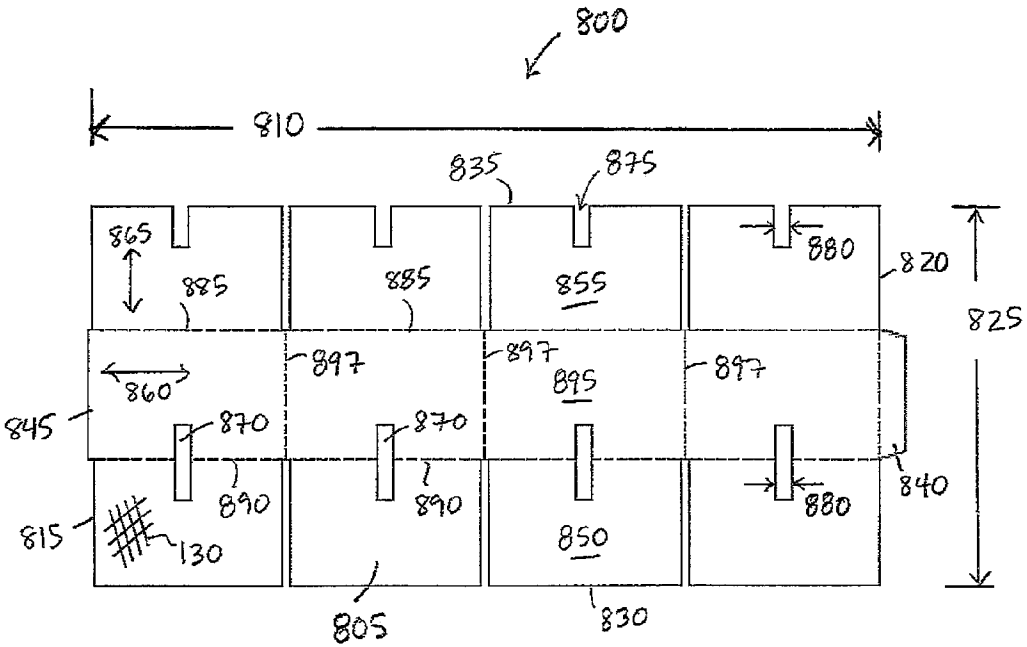

Turning to FIG. 11A, frame 800 is shown in an unassembled configuration. Frame 800 is formed from a single sheet 805 of corrugated fiberboard 130 having a generally rectangular shape with a length 810 extending between two edges 815, 820, and a width 825 extending between two edges 830, 835. A tab 840 extends substantially normally from edge 820, while a lip 845 extends substantially normally from edge 815. Tab 840 and lip 845 enable fastening of edge 815 to edge 820. In some embodiments, tab 840 is glued to a surface of sheet 805 over lip 845 proximate edge 815 when sheet 805 is folded as shown in FIG. 11B. Still referring to FIG. 11A, edge 830 includes four flaps 850 and edge 835 includes four flaps 855. All flaps 850, 855 are substantially the same size. Sheet 805 further includes four slots 870 extending normally between edges 830, 835 and offset from the center of sheet 805 toward edge 830, and four slots 875 extending normally to and inward from edge 835. Further, each slot 875 aligns with one slot 870. Slots 870, 875 have substantially the same width 880, and each slot 870 is approximately twice as long as each slot 875. To promote the strength of frame 800, and thus box 100, the corrugation of fiberboard 130 preferably extends normally between edges 815, 820 of sheet 805, indicated by direction 860, or normally between edges 830, 835 of sheet 805, indicated by direction 865. In other embodiments, however, the corrugation direction of sheet 805 may extend in a direction angularly offset from directions 860, 865.

To assemble frame 800, sheet 805 is folded along dotted lines 897 and tab 840 is fastened over lip 845, such as by gluing, to form a hollow, substantially rectangular enclosure open at both ends. Flaps 850 of sheet 805 are folded along dotted lines 890, and flaps 855 are folded along dotted lines 885 such that center portions 895 are sandwiched between flaps 850, 855, yielding the assembled configuration of frame 800 shown in FIG. 11B. In preferred embodiments, flaps 850, 855 are folded such that flaps 855 are positioned on the interior of assembled frame 800, while flaps 850 are positioned on the exterior of assembled frame 800, as shown. Alternatively, in some embodiments, flaps 850, 855 may be folded such that flaps 850, 855 are positioned on the interior and exterior, respectively, of assembled frame 800. When flaps 850 are folded along dotted lines 890 as described, each slot 870 is folded approximately at its midpoint, such that one half of slot 870 overlaps the other half of slot 870. Also, when flaps 855 are folded along dotted lines 885 as described, each slot 875 aligns and overlaps with the two overlapping halves of a slot 870. For convenience, each group of overlapping slots 870, 875 is referred to herein as a slot 894. Also, dotted lines 885 along which flaps 855 are folded form edge 877 of assembled frame 800.

Figure 12B:
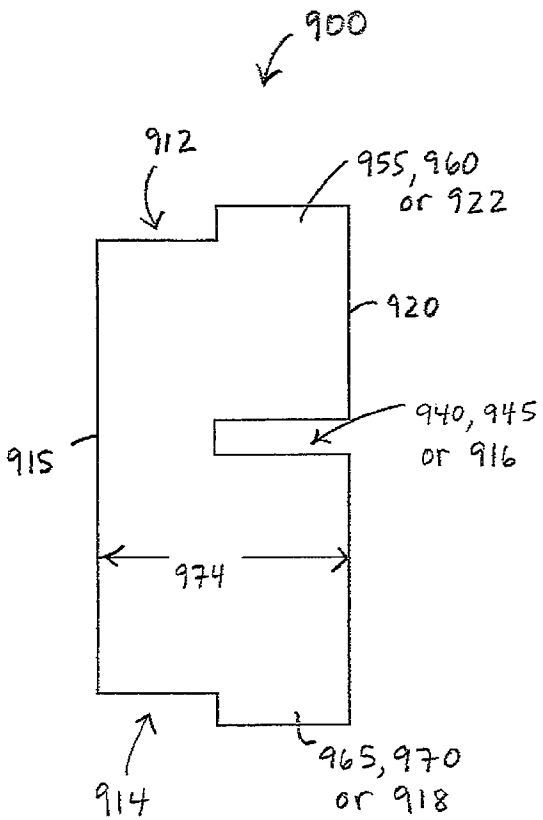
FIGS. 12A and 12B are unfolded and folded views, respectively, of one divider panel of the partition assembly of FIG. 10.
Figure 12A:
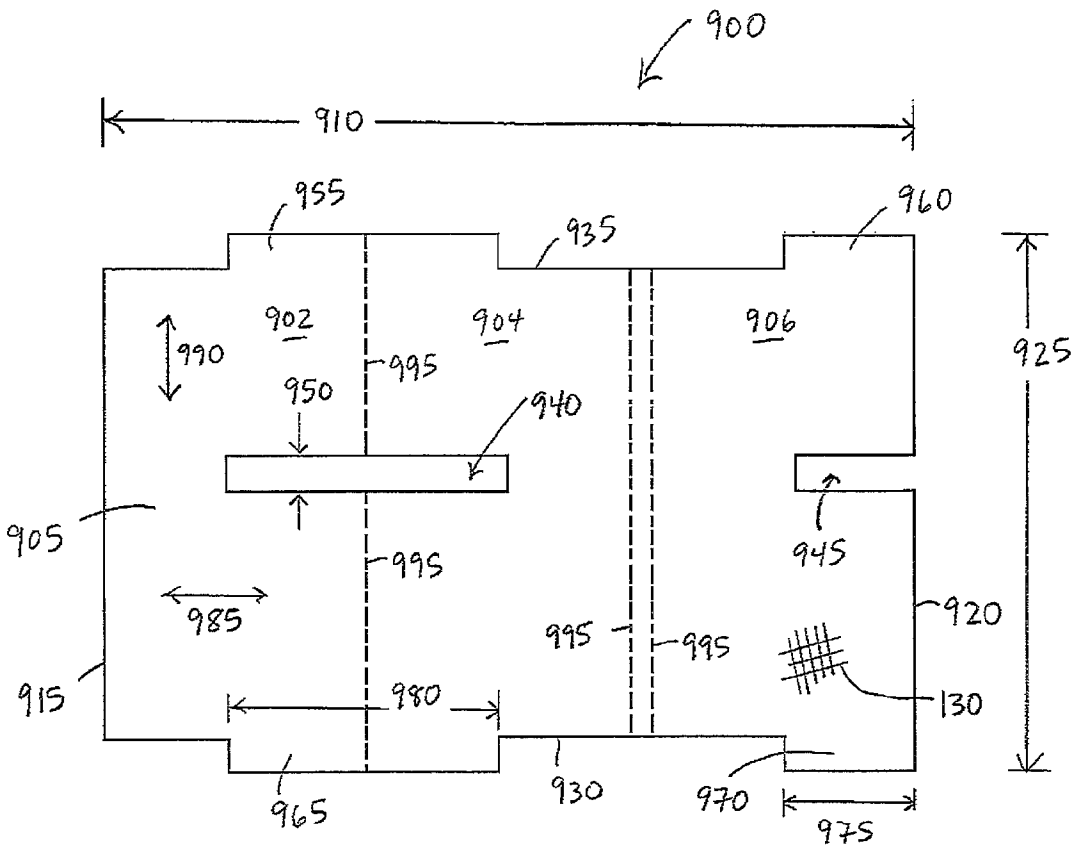

Referring now to FIGS. 12A and 12B, first divider 900 is shown in unfolded and folded configurations, respectively. First divider 900 is formed from a single sheet 905 of corrugated fiberboard 130 having a generally rectangular shape with a length 910 extending between two edges 915, 920 and a width 925. Sheet 905 further includes a slot 940 to the left of the midsection of sheet 905 and an aligned slot 945 proximate edge 920. Slots 940, 945 extend substantially in a direction normal to edges 915, 920, and have substantially the same width 950. Sheet 905 further includes two tabs 955, 960 extending from an edge 935 and two tabs 965, 970 extending from an edge 930. Tabs 960, 970 each have a length 975 that is substantially equal to half the length 980 of tabs 955, 965. To promote the strength of first divider 900, the corrugation of fiberboard 130 preferably extends normally between edges 930, 935 of sheet 905, indicated by direction 990. In other embodiments, however, the corrugation direction of sheet 905 may extend normally between edges 915, 920 of sheet 905, indicated by direction 985, or in a direction angularly offset from directions 985, 990.

To assemble first divider 900, sheet 905 is folded along dotted lines 995 such that left portion 902 is sandwiched between center portion 904 and right portion 906, yielding the folded configuration shown in FIG. 12B. When folded along dotted lines 995 as described, slot 940 is folded approximately at its midpoint, such that one half of slot 940 overlaps the other half of slot 940, and both halves of slot 940 align with slot 945. Also, tab 955 is folded approximately at its midpoint, such that one half of tab 955 overlaps the other half of tab 955, and both halves of tab 955 align with tab 960. Similarly, tab 965 is folded approximately at its midpoint, such that one half of tab 965 overlaps the other half of tab 965, and both halves of tab 965 align with tab 970. When tabs 955, 960 overlap as shown in FIG. 12B, notch 912 is formed in first divider 900 adjacent overlapping tabs 955, 960. Similarly, when tabs 965, 970 overlap as shown in FIG. 12B, notch 514 is formed in first divider 900 adjacent overlapping tabs 965, 970. For convenience, overlapping tabs 955, 960 are referred to herein as tab 922, while overlapping tabs 965, 970 are referred to herein as tab 918. Aligned slots 940, 945 are referred to herein as slot 916.

Figure 13B:
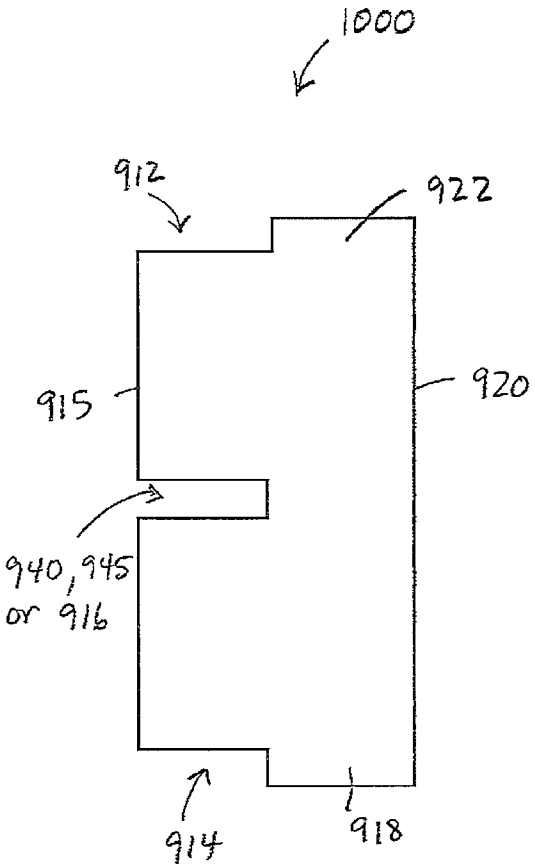
FIGS. 13A and 13B are unfolded and folded views, respectively, of the other divider panel of the partition assembly of FIG. 10.
Figure 13A:
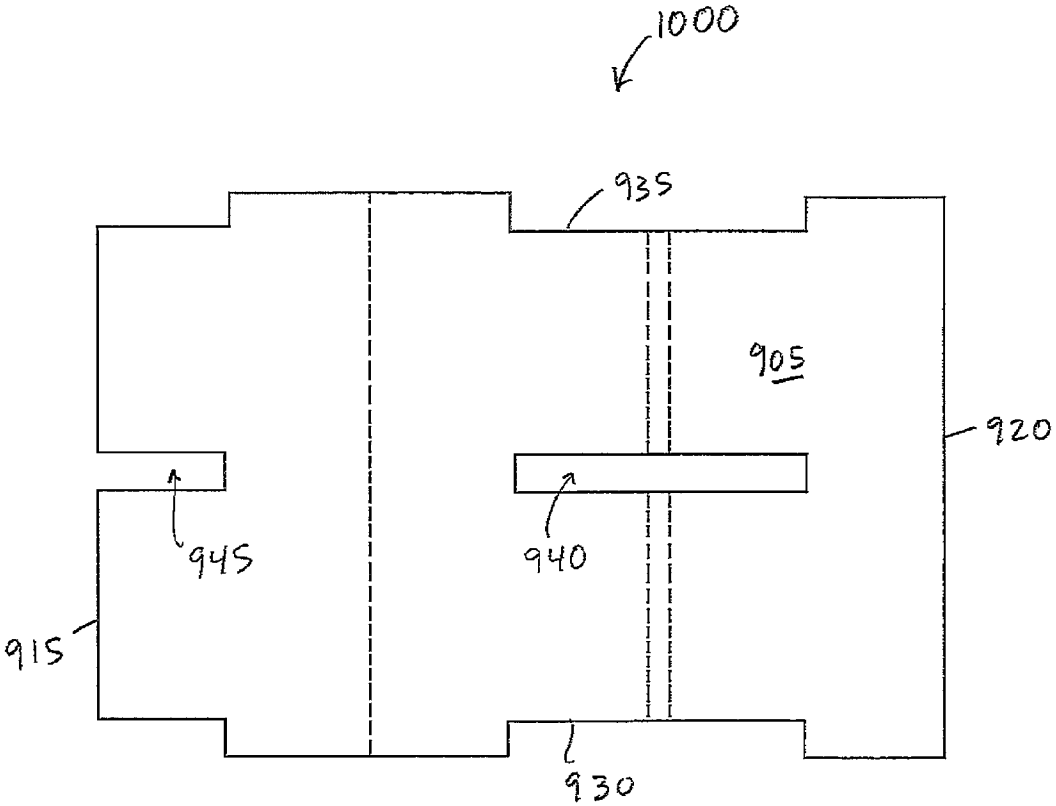

Turning to FIGS. 13A and 13B, second divider 1000 is shown in unfolded and folded configurations, respectively. Second divider 1000 is substantially identical to first divider 900 except for the positions of slots 940, 945. As previously described and shown in FIG. 12A, first divider 900 includes slot 945 extending substantially normally to and inward from edge 920 and slot 940 to the left of the midsection of sheet 905. Returning to FIG. 13A, second divider 1000, instead, includes slot 945 extending substantially normally to and inward from edge 915, not edge 920, and slot 940 is to the right, not the left, of the midsection of sheet 905.

To form partition assembly 1100 from frame 800, first divider 900 and second divider 1000, as shown in FIG. 10, first divider 900 is positioned in engagement with frame 800 such that tab 922 of first divider 900 is inserted into one slot 894 of frame 800 and tab 918 of first divider 900 is inserted into the opposing slot 894 of frame 800. To complete assembly of partition assembly 1100, second divider 1000 is positioned in engagement with frame 800 and first divider 900 such that second divider 1000 is substantially orthogonal to first divider 900, tab 922 of second divider 1000 is inserted into one slot 894 of frame 800, tab 918 of second divider 1000 is inserted into the opposing slot 894 of frame 800, and slot 916 of first divider 900 receives slot 916 of second divider 1000.

Partition assembly 1100 is next positioned within shell 110 in engagement with and supported by bottom insert 115. Partition assembly 1100 may be positioned within shell 110 such that edges 915 of first and second dividers 900, 1000 and edges 877 of frame 800 engage bottom insert 115. Alternatively, partition assembly 1100 may be positioned within shell 110 in the opposite orientation, meaning with edges 920 of first and second dividers 900, 1000 and edges 835 of frame 800 engaging bottom insert 115.

Referring again to FIG. 10, the height 1110 of partition assembly 1100 is determined by the maximum of height 874 (FIG. 11B) of frame 800 and height 974 (FIG. 12B) of first and second dividers 900, 1000. Height 1110 may vary as needed or desired, its maximum value limited only by the ability of box 100 to be completely closed and sealed with bottom insert 115, partition assembly 1100, containers 105, and top insert 125 disposed therein. The minimum value of height 1110 is limited by the ability of box 100 to satisfy the United Nations testing requirements previously described.

A 4G fiberboard box in accordance with the principles disclosed herein, including box 100 with partition assembly 120 or partition assembly 1100, satisfies the United Nations regulations governing certified containers for the transport of hazardous materials. The disclosed 4G fiberboard box satisfies the testing requirements outlined in the Hazardous Materials Regulations (Title 49 CFR Parts 100-185) as well as the additional general requirements for non-bulk packagings and packages outlined in Section 173.24a. At the same time, the disclosed 4G fiberboard box is shippable in a 3×3 configuration on a 46"×46" standard shipping pallet. Thus, the 4G fiberboard box promotes the shipping efficiency of hazardous materials.

While various preferred embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A 4G fiberboard box comprising:

an outer shell configured such that a three by three array of nine of the shipping containers is transportable on a standard 46 inch by 46 inch pallet; and a partition assembly disposed within the shell, the partition assembly comprising six substantially identical panels assembled to define four compartments, each compartment configured to receive a container, each container configured to store hazardous material;

wherein each panel is formed from a substantially rectangular sheet of corrugated fiberboard having a first slot and a second slot substantially twice as long as the first slot; and wherein the 4G fiberboard box is certified for shipping hazardous materials in accordance with United Nations regulations.

2. The 4G fiberboard box of claim 1, wherein each panel comprises a pair of tabs, each tab extending from opposing edges of the panel, and a slot.

3. The 4G fiberboard box of claim 1, wherein each panel is formed solely from corrugated fiberboard.

4. The 4G fiberboard box of claim 1, wherein, when the sheet is folded into three sections, the second slot is folded proximate its midpoint such that one half of the second slot overlaps the other half of the second slot and both halves of the second slot align with and overlap the first slot.

5. The 4G fiberboard box of claim 1, wherein the sheet further comprises:

a first and a second tab extending from a first edge of the sheet, the first tab having a length substantially twice as long as the second tab; and a third and a fourth tab extending from a second edge of the sheet opposite the first edge, the third tab having a length substantially twice as long as the fourth tab.

6. The 4G fiberboard box of claim 5, wherein, when the sheet is folded into three sections, the first and the third tabs are each folded into halves, both halves of the first tab align with the second tab, and both halves of the third tab align with the fourth tab.

* * * * *